US011274860B2

(12) United States Patent
Schroeder

(10) Patent No.: US 11,274,860 B2
(45) Date of Patent: Mar. 15, 2022

(54) MECHANO-CALORIC STAGE WITH INNER AND OUTER SLEEVES

(71) Applicant: Haier US Appliance Solutions, Inc., Wilmington, DE (US)

(72) Inventor: Michael Goodman Schroeder, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 270 days.

(21) Appl. No.: 16/242,060

(22) Filed: Jan. 8, 2019

(65) Prior Publication Data

US 2020/0217567 A1 Jul. 9, 2020

(51) Int. Cl.
*F25B 23/00* (2006.01)
*F25B 30/00* (2006.01)

(52) U.S. Cl.
CPC ..... *F25B 23/00* (2013.01); *F25B 30/00* (2013.01)

(58) Field of Classification Search
CPC ..... H01F 7/021; H01F 7/0221; H01F 7/0226; H01F 7/0247; H01F 7/0252; H01F 7/0263; H01F 1/012; F25B 2321/00; F25B 2321/002; F25B 2321/0021; F25B 2321/0022; F25B 2321/0023; F25B 21/10
See application file for complete search history.

(56) References Cited

U.S. PATENT DOCUMENTS 668,560 A 2/1901 Fulner et al.
1,985,455 A 12/1934 Mosby
2,671,929 A 3/1954 Gayler
2,765,633 A 10/1956 Muffly
3,618,265 A 11/1971 Croop
3,816,029 A 6/1974 Bowen et al.
3,844,341 A 10/1974 Bimshas, Jr. et al.
3,956,076 A 5/1976 Powell, Jr. et al.
4,037,427 A 7/1977 Kramer
4,102,655 A 7/1978 Jeffery et al.
4,107,935 A 8/1978 Steyert, Jr.
4,197,709 A 4/1980 Hochstein
(Continued)

FOREIGN PATENT DOCUMENTS

CA 2893874 A1 6/2014
CA 2919117 A1 1/2015
(Continued)

OTHER PUBLICATIONS

Mañosa and Planes, Mechanocaloric Effects in Shape Memory Alloys, 2016 (Year: 2016).*
(Continued)

*Primary Examiner* — Elizabeth J Martin
*Assistant Examiner* — Evan J. Cusick
(74) *Attorney, Agent, or Firm* — Dority & Manning, P.A.

(57) ABSTRACT

A mechano-caloric stage includes an elongated outer sleeve. An elongated inner sleeve is disposed within the elongated outer sleeve. A pair of pistons is received within the elongated inner sleeve. Each of the pair of pistons is positioned at a respective end of the elongated inner sleeve. The pair of pistons are moveable relative to the elongated inner sleeve. A mechano-caloric material is disposed within the elongated inner sleeve between the pair of pistons. The mechano-caloric material is compressible between the pair of pistons.

18 Claims, 8 Drawing Sheets

(56) References Cited

U.S. PATENT DOCUMENTS 4,200,680 A 4/1980 Sasazawa et al.
4,259,843 A 4/1981 Kausch
4,332,135 A 6/1982 Barclay et al.
4,408,463 A 10/1983 Barclay
4,507,927 A 4/1985 Barclay
4,507,928 A 4/1985 Johnson
4,549,155 A 10/1985 Halbach
4,554,790 A 11/1985 Nakagome et al.
4,557,228 A 12/1985 Samodovitz
4,599,866 A 7/1986 Nakagome et al.
4,625,519 A 12/1986 Hakuraku et al.
4,642,994 A 2/1987 Barclay et al.
4,735,062 A 4/1988 Woolley et al.
4,741,175 A 5/1988 Schulze
4,785,636 A 11/1988 Hakuraku et al.
4,796,430 A 1/1989 Malaker et al.
5,062,471 A 11/1991 Jaeger
5,091,361 A 2/1992 Hed
5,156,003 A 10/1992 Yoshiro et al.
5,190,447 A 3/1993 Schneider
5,249,424 A 10/1993 DeGregoria et al.
5,336,421 A 8/1994 Kurita et al.
5,351,791 A 10/1994 Rosenzweig
5,465,781 A 11/1995 DeGregoria
5,599,177 A 2/1997 Hetherington
5,661,895 A 9/1997 Irgens
5,718,570 A 2/1998 Beckett et al.
5,934,078 A 8/1999 Lawton, Jr. et al.
6,332,323 B1 12/2001 Reid et al.
6,423,255 B1 7/2002 Hoechsmann et al.
6,446,441 B1 9/2002 Dean
6,467,274 B2 10/2002 Barclay et al.
6,517,744 B1 2/2003 Hara et al.
6,526,759 B2 3/2003 Zimm et al.
6,588,215 B1 7/2003 Ghoshal
6,612,816 B1 9/2003 Vanden Brande et al.
6,668,560 B2 12/2003 Zimm et al.
6,826,915 B2 12/2004 Wada et al.
6,840,302 B1 1/2005 Tanaka et al.
6,915,647 B2 7/2005 Tsuchikawa et al.
6,935,121 B2 8/2005 Fang et al.
6,946,941 B2 9/2005 Chell
6,971,245 B2 12/2005 Kuroyanagi
7,148,777 B2 12/2006 Chell et al.
7,297,270 B2 11/2007 Bernard et al.
7,313,926 B2 1/2008 Gurin
7,481,064 B2 1/2009 Kitanovski et al.
7,552,592 B2 6/2009 Iwasaki et al.
7,644,588 B2 1/2010 Shin et al.
7,863,789 B2 1/2011 Zepp et al.
7,897,898 B2 3/2011 Muller et al.
7,938,632 B2 5/2011 Smith
8,061,147 B2 11/2011 Dinesen et al.
8,069,662 B1 12/2011 Albert
8,099,964 B2 1/2012 Saito et al.
8,174,245 B2 5/2012 Carver
8,191,375 B2 6/2012 Sari et al.
8,209,988 B2 7/2012 Zhang et al.
8,216,396 B2 7/2012 Dooley et al.
8,310,325 B2 11/2012 Zhang et al.
8,375,727 B2 2/2013 Sohn
8,378,769 B2 2/2013 Heitzler et al.
8,448,453 B2 5/2013 Bahl et al.
8,551,210 B2 10/2013 Reppel et al.
8,596,084 B2 12/2013 Herrera et al.
8,616,009 B2 12/2013 Dinesen et al.
8,656,725 B2 2/2014 Muller et al.
8,695,354 B2 4/2014 Heitzler et al.
8,729,718 B2 5/2014 Kuo et al.
8,763,407 B2 7/2014 Carroll et al.
8,769,966 B2 7/2014 Heitzler et al.
8,869,541 B2 10/2014 Heitzler et al.
8,904,806 B2 12/2014 Cramet et al.
8,935,927 B2 1/2015 Kobayashi et al.
8,978,391 B2 3/2015 Muller et al.
9,175,885 B2 11/2015 Katter
9,245,673 B2 1/2016 Carroll et al.
9,377,221 B2 6/2016 Benedict
9,400,126 B2 7/2016 Takahashi et al.
9,523,519 B2 12/2016 Muller
9,534,817 B2 1/2017 Benedict et al.
9,548,151 B2 1/2017 Muller
9,599,374 B2 3/2017 Takahashi et al.
9,631,843 B2 4/2017 Benedict
9,702,594 B2 7/2017 Vetrovec
9,739,510 B2 8/2017 Hassen
9,746,214 B2 8/2017 Zimm et al.
9,797,630 B2 10/2017 Benedict et al.
9,810,454 B2 11/2017 Tasaki et al.
9,857,105 B1 1/2018 Schroeder et al.
9,857,106 B1 1/2018 Schroeder et al.
9,927,155 B2 3/2018 Boeder et al.
9,978,487 B2 5/2018 Katter et al.
10,006,675 B2 6/2018 Benedict et al.
10,018,385 B2 7/2018 Radermacher et al.
10,684,044 B2 6/2020 Schroeder
2002/0040583 A1 4/2002 Barclay et al.
2002/0066368 A1 6/2002 Zornes
2002/0087120 A1 7/2002 Rogers et al.
2003/0010054 A1 1/2003 Esch et al.
2003/0051774 A1 3/2003 Saito
2004/0093877 A1 5/2004 Wada
2004/0182086 A1 9/2004 Chiang et al.
2004/0187510 A1 9/2004 Jung
2004/0187803 A1 9/2004 Regev
2004/0250550 A1 12/2004 Bruck
2005/0017394 A1 1/2005 Hochsmann et al.
2005/0046533 A1 3/2005 Chell
2005/0109490 A1 5/2005 Harmon et al.
2005/0217278 A1 10/2005 Mongia et al.
2005/0263357 A1 12/2005 Kuwahara
2005/0274676 A1 12/2005 Kumar et al.
2006/0130518 A1 6/2006 Kang et al.
2006/0231163 A1 10/2006 Hirosawa et al.
2006/0279391 A1 12/2006 Xia
2007/0130960 A1 6/2007 Muller et al.
2007/0220901 A1 9/2007 Kobayashi
2008/0223853 A1 9/2008 Muller et al.
2008/0236171 A1 10/2008 Saito et al.
2008/0236175 A1 10/2008 Chaparro Monferrer et al.
2008/0303375 A1 12/2008 Carver
2009/0032223 A1 2/2009 Zimmerman et al.
2009/0091411 A1 4/2009 Zhang et al.
2009/0158749 A1 6/2009 Sandeman
2009/0217674 A1 9/2009 Kaji et al.
2009/0236930 A1 9/2009 Nashiki
2009/0266083 A1 10/2009 Shin et al.
2009/0308080 A1 12/2009 Han et al.
2009/0314860 A1 12/2009 Wang et al.
2009/0320499 A1 12/2009 Muller et al.
2010/0000228 A1 1/2010 Wiest et al.
2010/0058775 A1 3/2010 Kaji et al.
2010/0071383 A1 3/2010 Zhang et al.
2010/0116471 A1 5/2010 Reppel et al.
2010/0122488 A1 5/2010 Fukai
2010/0150747 A1 6/2010 Mehta et al.
2010/0162747 A1 7/2010 Hamel et al.
2010/0209084 A1 8/2010 Nelson et al.
2010/0236258 A1 9/2010 Heitzler et al.
2010/0276627 A1 11/2010 Mazet
2010/0303917 A1 12/2010 Watson et al.
2011/0000206 A1 1/2011 Aprad
2011/0042608 A1 2/2011 Reesink
2011/0048031 A1 3/2011 Barve
2011/0048690 A1 3/2011 Reppel et al.
2011/0058795 A1 3/2011 Kleman et al.
2011/0061398 A1 3/2011 Shih et al.
2011/0062821 A1 3/2011 Chang et al.
2011/0082026 A1 4/2011 Sakatani et al.
2011/0094243 A1 4/2011 Carroll et al.
2011/0129363 A1 6/2011 Sakai et al.
2011/0154832 A1 6/2011 Barve et al.
2011/0162388 A1 7/2011 Barve et al.
2011/0168363 A9 7/2011 Reppel et al.

(56) References Cited

U.S. PATENT DOCUMENTS

2011/0173993 A1 7/2011 Muller et al.
2011/0182086 A1 7/2011 Mienko et al.
2011/0192836 A1 8/2011 Muller et al.
2011/0218921 A1 9/2011 Addala et al.
2011/0239662 A1 10/2011 Bahl et al.
2011/0284196 A1 11/2011 Zanadi
2011/0302931 A1 12/2011 Sohn
2011/0308245 A1* 12/2011 Tice ..... F01K 25/08 60/531
2011/0308258 A1 12/2011 Smith et al.
2011/0314836 A1 12/2011 Heitzler et al.
2012/0031108 A1 2/2012 Kobayashi et al.
2012/0033002 A1 2/2012 Seeler et al.
2012/0036868 A1 2/2012 Heitzler et al.
2012/0045698 A1 2/2012 Shima
2012/0060526 A1 3/2012 May et al.
2012/0079834 A1 4/2012 Dinesen
2012/0103301 A1* 5/2012 Vazquez ..... F01C 21/08 123/210
2012/0222427 A1 9/2012 Hassen
2012/0222428 A1 9/2012 Celik et al.
2012/0266591 A1 10/2012 Morimoto et al.
2012/0266607 A1 10/2012 Morimoto et al.
2012/0267090 A1 10/2012 Kruglick
2012/0272665 A1 11/2012 Watanabe et al.
2012/0272666 A1 11/2012 Watanabe
2012/0285179 A1 11/2012 Morimoto
2012/0291453 A1 11/2012 Watanabe et al.
2013/0019610 A1 1/2013 Zimm et al.
2013/0020529 A1 1/2013 Chang et al.
2013/0104568 A1 5/2013 Kuo et al.
2013/0106116 A1 5/2013 Kuo et al.
2013/0145573 A1 6/2013 Bizhanzadeh
2013/0180263 A1 7/2013 Choi et al.
2013/0186107 A1 7/2013 Shih et al.
2013/0187077 A1 7/2013 Katter
2013/0192269 A1 8/2013 Wang
2013/0199460 A1 8/2013 Duplessis et al.
2013/0200293 A1 8/2013 Zhao et al.
2013/0227965 A1 9/2013 Yagi et al.
2013/0232993 A1 9/2013 Saito et al.
2013/0255279 A1 10/2013 Tomimatsu et al.
2013/0269367 A1 10/2013 Meillan
2013/0298571 A1 11/2013 Morimoto et al.
2013/0300243 A1 11/2013 Gieras et al.
2013/0319012 A1 12/2013 Kuo et al.
2013/0327062 A1 12/2013 Watanabe et al.
2014/0020881 A1 1/2014 Reppel et al.
2014/0075958 A1 3/2014 Takahashi et al.
2014/0116538 A1 5/2014 Tanaka et al.
2014/0157793 A1 6/2014 Johnson et al.
2014/0165594 A1 6/2014 Benedict
2014/0165595 A1 6/2014 Zimm et al.
2014/0190182 A1 7/2014 Benedict
2014/0216057 A1 8/2014 Oezcan
2014/0260373 A1 9/2014 Gerber et al.
2014/0290273 A1 10/2014 Benedict et al.
2014/0290275 A1 10/2014 Muller
2014/0291570 A1 10/2014 Klausner et al.
2014/0305137 A1 10/2014 Benedict
2014/0305139 A1 10/2014 Takahashi et al.
2014/0311165 A1 10/2014 Watanabe et al.
2014/0325996 A1 11/2014 Muller
2014/0366557 A1 12/2014 Mun et al.
2015/0007582 A1 1/2015 Kim et al.
2015/0027133 A1* 1/2015 Benedict ..... F25B 21/00 62/3.1
2015/0030483 A1 1/2015 Ryu
2015/0033762 A1 2/2015 Cheng et al.
2015/0033763 A1 2/2015 Saito et al.
2015/0047371 A1 2/2015 Hu et al.
2015/0068219 A1 3/2015 Komorowski et al.
2015/0089960 A1 4/2015 Takahashi et al.
2015/0096307 A1 4/2015 Watanabe et al.
2015/0114007 A1 4/2015 Neilson et al.
2015/0168030 A1 6/2015 Leonard et al.
2015/0184903 A1 7/2015 Mun et al.
2015/0211440 A1 7/2015 Joffroy
2015/0260433 A1 9/2015 Choi et al.
2015/0267943 A1 9/2015 Kim et al.
2015/0362224 A1 12/2015 Benedict et al.
2015/0362225 A1 12/2015 Schwartz
2015/0369524 A1 12/2015 Ikegami et al.
2016/0000999 A1 1/2016 Focht et al.
2016/0025385 A1 1/2016 Auringer et al.
2016/0032920 A1 2/2016 Hatami Aghdam
2016/0084544 A1 3/2016 Radermacher et al.
2016/0091227 A1 3/2016 Leonard et al.
2016/0146515 A1 5/2016 Momen et al.
2016/0216012 A1 7/2016 Benedict et al.
2016/0238287 A1 8/2016 Benedict
2016/0273811 A1 9/2016 Smith et al.
2016/0282021 A1 9/2016 Zhao et al.
2016/0298880 A1 10/2016 Humburg
2016/0355898 A1 12/2016 Vieyra Villegas et al.
2016/0356529 A1 12/2016 Humburg
2016/0367982 A1 12/2016 Pennie
2017/0059213 A1 3/2017 Barclay et al.
2017/0059215 A1 3/2017 Watanabe et al.
2017/0071234 A1 3/2017 Garg
2017/0130999 A1* 5/2017 Numazawa ..... F25B 21/00
2017/0138648 A1 5/2017 Cui et al.
2017/0176083 A1 6/2017 Sul et al.
2017/0309380 A1 10/2017 Benedict et al.
2017/0328603 A1 11/2017 Barclay et al.
2017/0328649 A1 11/2017 Brandmeier
2017/0370624 A1 12/2017 Zimm et al.
2018/0005735 A1 1/2018 Scharf et al.
2018/0023852 A1 1/2018 Schroeder et al.
2018/0045437 A1 2/2018 Vetrovec
2018/0195775 A1 7/2018 Schroeder et al.
2018/0283740 A1 10/2018 Holladay et al.
2018/0340715 A1 11/2018 Benedict et al.
2019/0206578 A1 7/2019 Wong

FOREIGN PATENT DOCUMENTS

CN 1977131 A 6/2007
CN 101280983 A 10/2008
CN 101495818 A 7/2009
CN 101842647 A 9/2010
CN 101979937 A 2/2011
CN 201772566 U 3/2011
CN 102165615 A 8/2011
CN 101788207 B 9/2011
CN 102345942 A 2/2012
CN 202432596 U 9/2012
CN 103090583 A 5/2013
CN 103712401 A 4/2014
CN 102077303 B 4/2015
CN 106481842 A 3/2017
CN 106949673 A 7/2017
CN 107003041 A 8/2017
DE 804694 C 4/1951
DE 1514388 A1 6/1969
DE 102013223959 A1 5/2015
DE 202015106851 U1 3/2016
EP 0187078 A1 7/1986
EP 2071255 A1 6/2009
EP 2108904 A1 10/2009
EP 2215955 A1 8/2010
EP 2322072 A2 5/2011
EP 2420760 A1 2/2012
EP 2813785 A1 12/2014
EP 3306082 A2 4/2018
FR 2935468 A1 3/2010
JP 59232922 A 12/1984
JP H08166182 A 6/1996
JP 3205196 B2 9/2001
JP 2002315243 A 10/2002
JP 2007147136 A 6/2007
JP 2007291437 A 11/2007
JP 2008051412 A 3/2008
JP 2010112606 A 5/2010

(56) References Cited

FOREIGN PATENT DOCUMENTS

| | | | |
|---|---|---|---|
| JP | 2010525291 | A | 7/2010 |
| JP | 6212955 | B2 | 12/2014 |
| JP | 2014228216 | A | 12/2014 |
| JP | 5907023 | B2 | 4/2016 |
| JP | 6079498 | B2 | 2/2017 |
| JP | 6191539 | B2 | 9/2017 |
| JP | 2017207222 | A | 11/2017 |
| KR | 101100301 | B1 | 12/2011 |
| KR | 101238234 | B1 | 3/2013 |
| WO | WO0133145 | A1 | 5/2001 |
| WO | WO0212800 | A1 | 2/2002 |
| WO | WO03016794 | A1 | 2/2003 |
| WO | WO2004/068512 | A1 | 8/2004 |
| WO | WO2007/036729 | A1 | 4/2007 |
| WO | WO2007/086638 | A1 | 8/2007 |
| WO | WO2009/024412 | A1 | 2/2009 |
| WO | WO2009/098391 | A1 | 8/2009 |
| WO | WO2010/119591 | A1 | 10/2010 |
| WO | WO2011034594 | A1 | 3/2011 |
| WO | WO2011152179 | A1 | 12/2011 |
| WO | WO2014099199 | A1 | 6/2014 |
| WO | WO2014170447 | A1 | 10/2014 |
| WO | WO2014173787 | A1 | 10/2014 |
| WO | WO2015017230 | A1 | 2/2015 |
| WO | WO2016005774 | A1 | 1/2016 |
| WO | WO2016035267 | A1 | 3/2016 |
| WO | WO2017042266 | A1 | 3/2017 |
| WO | WO2017081048 | A2 | 5/2017 |
| WO | WO2017097989 | A1 | 6/2017 |

OTHER PUBLICATIONS

International Search Report issued in connection with PCT Application No. PCT/US2014/042485 dated Oct. 23, 2014.

International Search Report issued in connection with PCT Application No. PCT/US2014/017431 dated May 9, 2014.

International Search Report issued in connection with PCT/US2013/070518, dated Jan. 22, 2014.

Tetsuji Okamura, Performance of a room-temperature rotary magnet refrigerator, dated Nov. 28, 2005, Elsevier.

Journal of Alloys and Compounds, copyright 2008 Elsevier B..V..

Evaluation of Ni—Mn—In—Si Alloys for Magnetic Refrigerant Application, Rahul Das, A. Perumal and A. Srinivasan, Dept of Physics, Indian Institute of Technology, Oct. 10, 2011.

Effects of annealing on the magnetic entropy change and exchange bias behavior in melt-spun Ni—Mn—In ribbons, X.Z. Zhao, C.C. Hsieh, et al Science Direct, Scripta Materialia 63 (2010).

PCT International Search Report and Written Opinion issued in connection with PCT Application No. PCT/US2013/070023 dated Feb. 27, 2014.

Barbara Pulko, Epoxy-bonded La—Fe—Co—Si magnetocaloric plates, Journal of Magnetism and Magnetic Materials, 375 (2015) 65-73.

International Search Report of PCT/US2014/047925 dated Nov. 10, 2014.

Andrej Kitanovski, Present and future caloric refrigeration and heat-pump technologies, International Journal of Refrigeration, vol. 57, Sep. 2015, pp. 288-298.

C Aprea, et al., An innovative rotary permanent magnet magnetic refrigerator based on AMR cycle, Thermal Energy Systems: Production, Storage, Utilization and the Environment, dated May 2015, Napoli, Italy, pp. 1-5.

International Search Report, PCT Application No. PCT/CN2019/096188, dated Oct. 15, 2019, 5 pages.

International Search Report, PCT Application No. PCT/CN2019/096187, dated Sep. 30, 2019, 4 pages.

Stefano Dall'Olio, et al., Numerical Simulation of a Tapered Bed AMR, Technical University of Denmark, 2015, 2 pages.

* cited by examiner

MECHANO-CALORIC STAGE WITH INNER AND OUTER SLEEVES

FIELD OF THE INVENTION

The present subject matter relates generally to mechano-caloric heat pumps for appliances.

BACKGROUND OF THE INVENTION

Conventional refrigeration technology typically utilizes a heat pump that relies on compression and expansion of a fluid refrigerant to receive and reject heat in a cyclic manner so as to effect a desired temperature change or transfer heat energy from one location to another. This cycle can be used to receive heat from a refrigeration compartment and reject such heat to the environment or a location that is external to the compartment. Other applications include air conditioning of residential or commercial structures. A variety of different fluid refrigerants have been developed that can be used with the heat pump in such systems.

While improvements have been made to such heat pump systems that rely on the compression of fluid refrigerant, at best such can still only operate at about forty-five percent or less of the maximum theoretical Carnot cycle efficiency. Also, some fluid refrigerants have been discontinued due to environmental concerns. The range of ambient temperatures over which certain refrigerant-based systems can operate may be impractical for certain locations. Other challenges with heat pumps that use a fluid refrigerant exist as well.

Mechano-caloric materials (MECMs), e.g. materials that exhibit the elasto-caloric or baro-caloric effect, provide a potential alternative to fluid refrigerants for heat pump applications. In general, MECMs exhibit a change in temperature in response to a change in strain. The theoretical Carnot cycle efficiency of a refrigeration cycle based on an MECM can be significantly higher than for a comparable refrigeration cycle based on a fluid refrigerant. As such, a heat pump system that can effectively use an MECM would be useful.

Challenges exist to the practical and cost competitive use of an MECM, however. In addition to the development of suitable MECMs, equipment that can attractively utilize an MECM is still needed. Currently proposed equipment may require relatively large and expensive mechanical systems, may be impractical for use in e.g., appliance refrigeration, and may not otherwise operate with enough efficiency to justify capital cost.

Accordingly, a heat pump system that can address certain challenges, such as those identified above, would be useful. Such a heat pump system that can also be used in a refrigerator appliance would also be useful.

BRIEF DESCRIPTION OF THE INVENTION

Aspects and advantages of the invention will be set forth in part in the following description, or may be apparent from the description, or may be learned through practice of the invention.

In a first example embodiment, a mechano-caloric stage includes an elongated outer sleeve. An elongated inner sleeve is disposed within the elongated outer sleeve. A pair of pistons is received within the elongated inner sleeve. Each of the pair of pistons is positioned at a respective end of the elongated inner sleeve. The pair of pistons are moveable relative to the elongated inner sleeve. A mechano-caloric material is disposed within the elongated inner sleeve between the pair of pistons. The mechano-caloric material is compressible between the pair of pistons.

In a second example embodiment, a mechano-caloric stage includes a metal elongated outer sleeve. A plastic elongated inner sleeve is disposed within the metal elongated outer sleeve. A pair of pistons is received within the plastic elongated inner sleeve. Each of the pair of pistons is positioned at a respective end of the plastic elongated inner sleeve. The pair of pistons are moveable relative to the plastic elongated inner sleeve. A mechano-caloric material is disposed within the plastic elongated inner sleeve between the pair of pistons. The mechano-caloric material is compressible between the pair of pistons. The mechano-caloric material is slidable against the elongated inner sleeve. The elongated outer sleeve defines a pair of ports. Each port of the pair of ports is positioned at a respective end of the elongated outer sleeve. The mechano-caloric material defines a channel that extends through the mechano-caloric material along a length of the mechano-caloric material. Each of the pair of pistons defines a passage that is contiguous with the channel of the mechano-caloric material and a respective one of the pair of ports.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
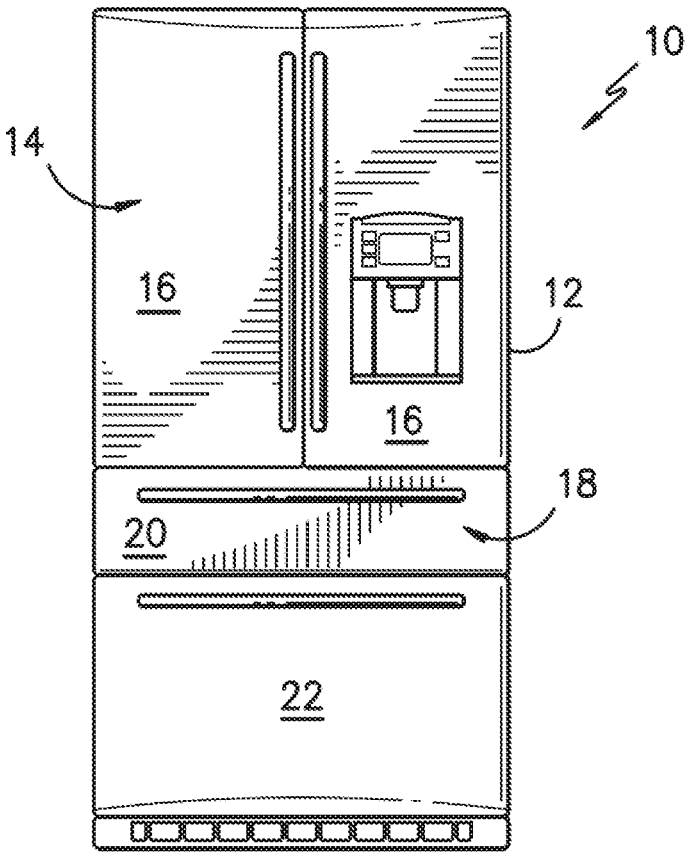
FIG. 1 is a front elevation view of a refrigerator appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to FIG. 1, an example embodiment of a refrigerator appliance 10 is depicted as an upright refrigerator having a cabinet or casing 12 that defines a number of internal storage compartments or chilled chambers. In particular, refrigerator appliance 10 includes upper fresh-food compartments 14 having doors 16 and lower freezer compartment 18 having upper drawer 20 and lower drawer 22. The drawers 20, 22 are "pull-out" type drawers in that they can be manually moved into and out of the freezer compartment 18 on suitable slide mechanisms.

Refrigerator 10 is provided by way of example only. Other configurations for a refrigerator appliance may be used as well including appliances with only freezer compartments, only chilled compartments, or other combinations thereof different from that shown in FIG. 1. In addition, the heat pump and heat pump system of the present invention is not limited to appliances and may be used in other applications as well such as e.g., air-conditioning, electronics cooling devices, and others. Further, it should be understood that while the use of a heat pump to provide cooling within a refrigerator is provided by way of example herein, the present invention may also be used to provide for heating applications as well.

Figure 2:
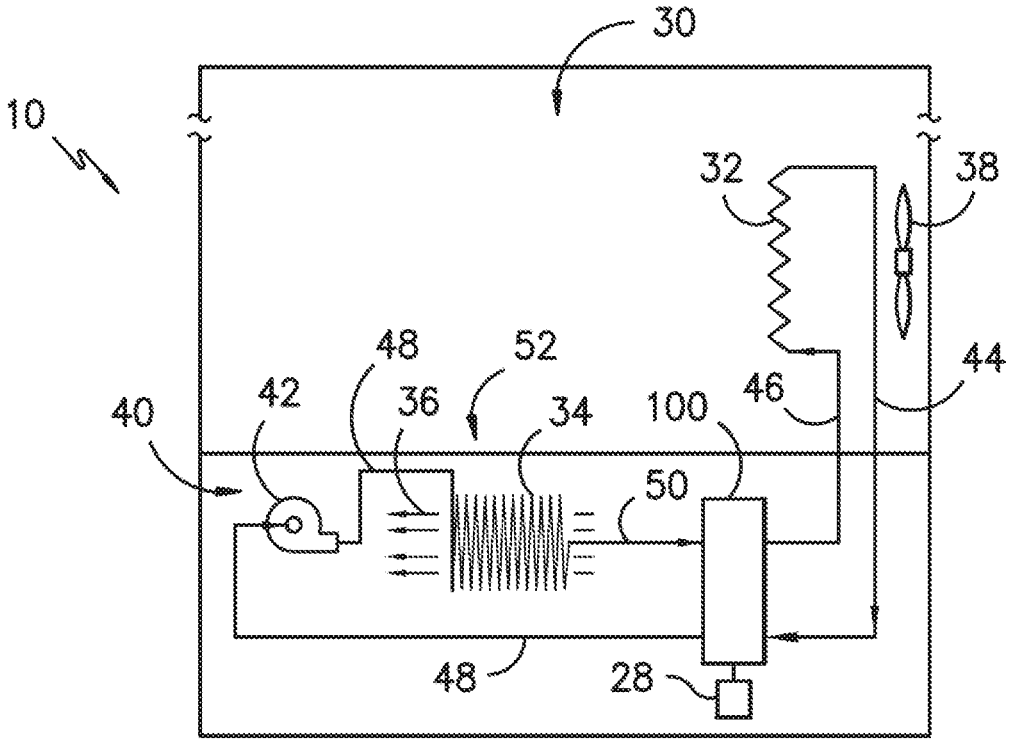
FIG. 2 is a schematic illustration of a heat pump system of the example refrigerator appliance of FIG. 1.

FIG. 2 is a schematic view of the refrigerator appliance 10. As may be seen in FIG. 2, refrigerator appliance 10 includes a refrigeration compartment 30 and a machinery compartment 40. Machinery compartment 30 includes a heat pump system 52 having a first heat exchanger 32 positioned in the refrigeration compartment 30 for the removal of heat therefrom. A heat transfer fluid such as e.g., an aqueous solution, flowing within first heat exchanger 32 receives heat from the refrigeration compartment 30 thereby cooling contents of the refrigeration compartment 30. A fan 38 may be used to provide for a flow of air across first heat exchanger 32 to improve the rate of heat transfer from the refrigeration compartment 30.

The heat transfer fluid flows out of first heat exchanger 32 by line 44 to heat pump 100. As will be further described herein, the heat transfer fluid receives additional heat from caloric material in heat pump 100 and carries this heat by line 48 to pump 42 and then to second heat exchanger 34. Heat is released to the environment, machinery compartment 40, and/or other location external to refrigeration compartment 30 using second heat exchanger 34. A fan 36 may be used to create a flow of air across second heat exchanger 34 and thereby improve the rate of heat transfer to the environment. Pump 42 connected into line 48 causes the heat transfer fluid to recirculate in heat pump system 52. Motor 28 is in mechanical communication with heat pump 100 as will further described.

From second heat exchanger 34 the heat transfer fluid returns by line 50 to heat pump 100 where, as will be further described below, the heat transfer fluid loses heat to the caloric material in heat pump 100. The now colder heat transfer fluid flows by line 46 to first heat exchanger 32 to receive heat from refrigeration compartment 30 and repeat the cycle as just described.

Heat pump system 52 is provided by way of example only. Other configurations of heat pump system 52 may be used as well. For example, lines 44, 46, 48, and 50 provide fluid communication between the various components of the heat pump system 52 but other heat transfer fluid recirculation loops with different lines and connections may also be employed. For example, pump 42 can also be positioned at other locations or on other lines in system 52. Still other configurations of heat pump system 52 may be used as well. For example, heat pump system 52 may be configured such that the caloric material in heat pump 100 directly cools air that flows through refrigeration compartment 30 and directly heats air external to refrigeration compartment 30. Thus, system 52 need not include a liquid working fluid in certain example embodiments.

Figure 3:
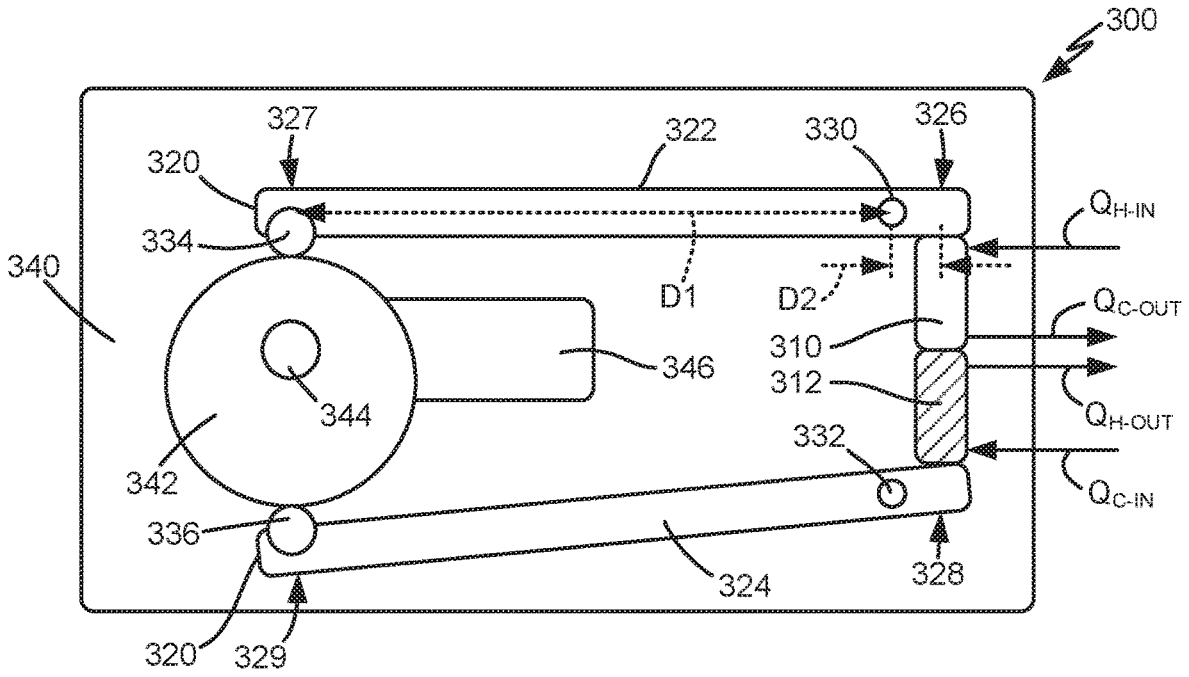
FIGS. 3 and 4 are schematic views of a mechano-caloric heat pump according to an example embodiment of the present subject matter.
Figure 4:
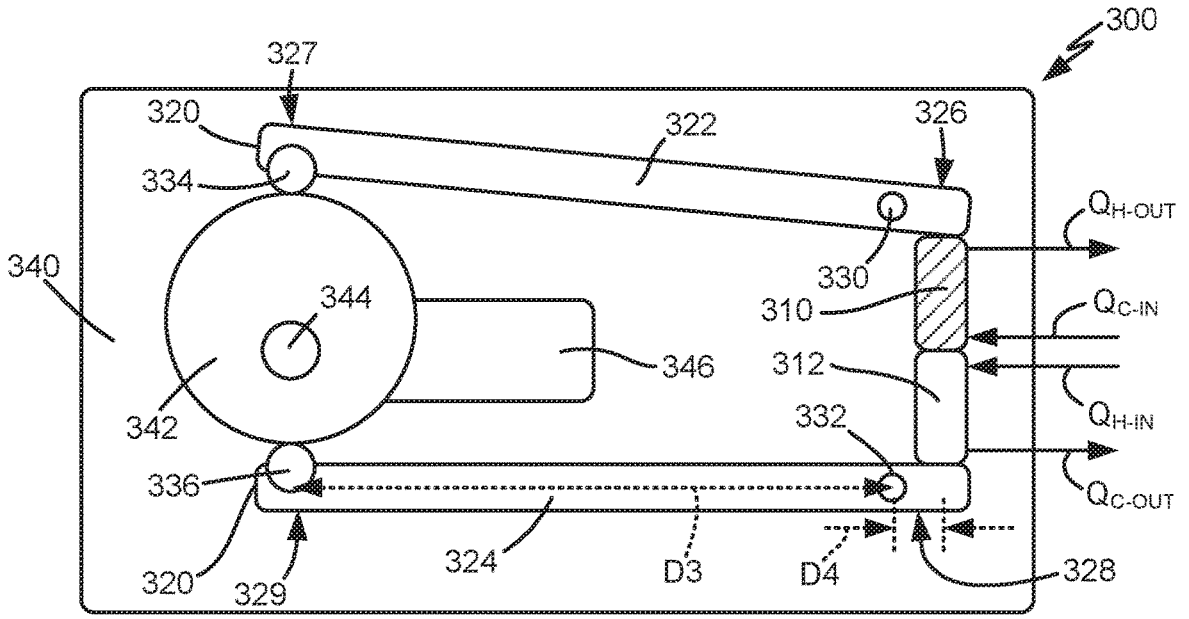

FIGS. 3 and 4 are schematic views of a mechano-caloric heat pump 300 according to an example embodiment of the present subject matter. Mechano-caloric heat pump 300 may be used in system 52 as heat pump 100, e.g., such that system 52 is an mechano-caloric heat pump system. Mechano-caloric heat pump 300 may be used in any other suitable heat pump system in alternative example embodiments. As discussed in greater detail below, mechano-caloric heat pump 300 includes features for stressing one or more mechano-caloric stages 310, 312 via pivoting of one or more elongated lever arms 320. Elongated lever arms 320 may apply a known force or pressure to the mechano-caloric stages 310, 312, and elastic deformation of elongated lever arms 320 may allow elongated lever arms 320 to translate a large force or pressure to mechano-caloric stages 310, 312 at first ends of elongated lever arms 320 via large displacement of the second, opposite ends of elongated lever arms 320 relative to the displacement of the first ends of elongated lever arms 320.

As may be seen in FIGS. 3 and 4 and discussed above, mechano-caloric heat pump 300 includes mechano-caloric stages 310, 312 and elongated lever arms 320. Elongated lever arms 320 may include a first elongated lever arm 322 and a second elongated lever arm 324. First elongated lever arm 322 extends between a first end portion 326 and a second end portion 327, e.g., along the length of first elongated lever arm 322. First elongated lever arm 322 is pivotable about a first point 330. For example, first elongated lever arm 322 may be mounted to an axle at first point 330.

A distance D1 between first end portion 326 of first elongated lever arm 322 and first point 330 is less than a distance D2 between second end portion 327 of first elongated lever arm 322 and first point 330. Thus, first elongated lever arm 322 is pivotable about first point 330 to provide a suitable mechanical advantage. As an example, the distance D1 may be no greater than half (½) of the distance D2. As another example, the distance D1 may be no greater than a quarter (¼) of the distance D2. As may be seen from the above, force applied at second end portion 327 of first elongated lever arm 322 is amplified at first end portion 326 of first elongated lever arm 322 via suitable selecting of the distances D1, D2.

Second elongated lever arm 324 also extends between a first end portion 328 and a second end portion 329, e.g., along the length of second elongated lever arm 324. Second elongated lever arm 324 is pivotable about a second point 340. For example, second elongated lever arm 324 may be mounted to an axle at second point 332. Second point 332 is spaced from first point 330. A distance D3 between first end portion 328 of second elongated lever arm 324 and second point 332 is less than a distance D4 between second end portion 329 of second elongated lever arm 324 and second point 332. The distances D3, D4 may be selected in the same or similar manner to that described above for the distances D1, D2 in order to provide a suitable mechanical advantage.

Mechano-caloric heat pump 300 also includes a motor 340, such as motor 28, that is operable to rotate a cam 342. First elongated lever arm 322 is coupled to cam 342 proximate second end portion 327 of first elongated lever arm 322. As an example, a roller 334 on second end portion 327 of first elongated lever arm 322 may contact and ride on cam 342. As another example, second end portion 327 of first elongated lever arm 322 may be directly connected to cam 342, e.g., via an axle. Second elongated lever arm 324 is coupled to cam 342 proximate second end portion 329 of second elongated lever arm 324. As an example, a roller 336 on second end portion 329 of second elongated lever arm 324 may contact and ride on cam 342. As another example, second end portion 329 of second elongated lever arm 324 may be directly connected to cam 342, e.g., via an axle. Due to the coupling of first and second elongated lever arms 322, 324, motor 340 is operable to pivot first elongated lever arm 322 about first point 330 and second elongated lever arm 324 about second point 332 as motor 340 rotates cam 342.

First and second elongated lever arms 322, 324 are also coupled to mechano-caloric stages 310, 312. For example, first elongated lever arm 322 is coupled to mechano-caloric stage 310 proximate first end portion 326 of first elongated lever arm 322, and second elongated lever arm 324 is coupled to mechano-caloric stage 312 proximate first end portion 328 of second elongated lever arm 324. Thus, motor 340 is operable to stress and/or deform mechano-caloric stages 310, 312 via pivoting of first and second elongated lever arms 322, 324 as motor 340 rotates cam 342. In particular, first and second elongated lever arms 322, 324 elastically deform as first and second elongated lever arms 322, 324 pivot on first and second points 330, 332, e.g., such that first and second elongated lever arms 322, 324 apply an elastic or spring force onto mechano-caloric stages 310, 312. The relatively large translation of first end portions 326, 328 of elongated lever arms 320 as elongated lever arms 320 pivot on first and second points 330, 332 may result in a relatively small translation of second end portions 327, 329 of elongated lever arms 320 and thus translation of a large force or pressure onto mechano-caloric stages 310, 312 as motor 340 rotates cam 342. As may be seen from the above, elastic deformation of elongated lever arms 320 and leverage may translate a large displacement at one end of elongated lever arms 320 into a large force with very low displacement at the opposite end of elongated lever arms 320.

Figure 5:
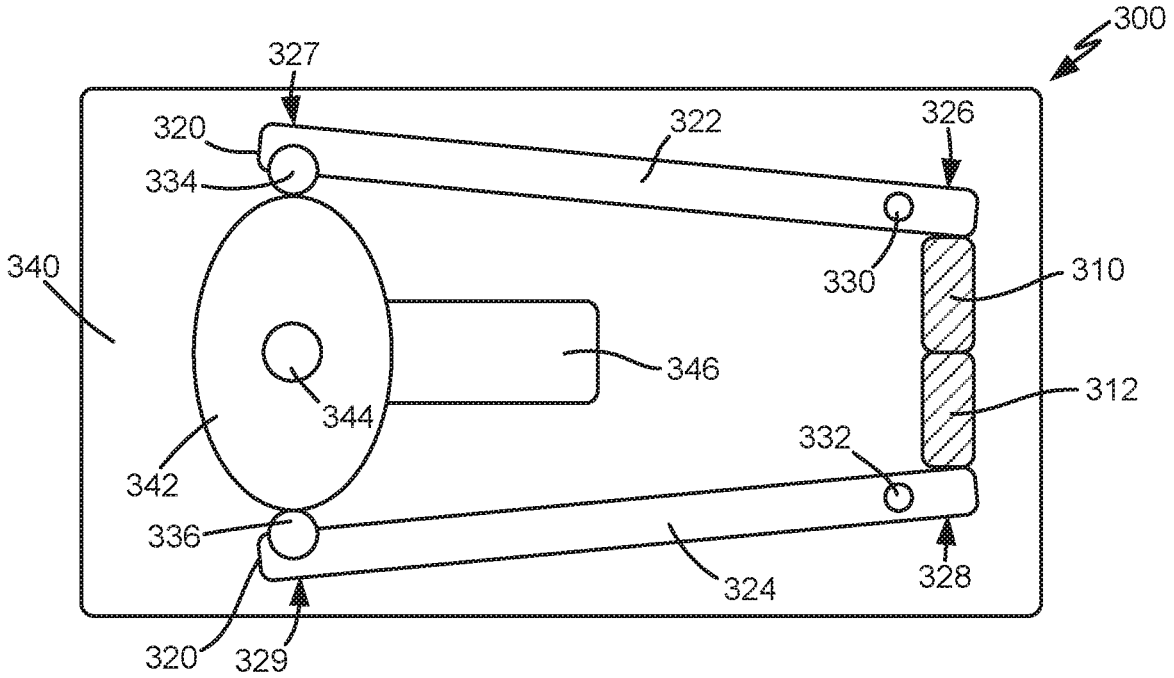
FIGS. 5 and 6 are schematic views of a mechano-caloric heat pump according to another example embodiment of the present subject matter.
Figure 6:
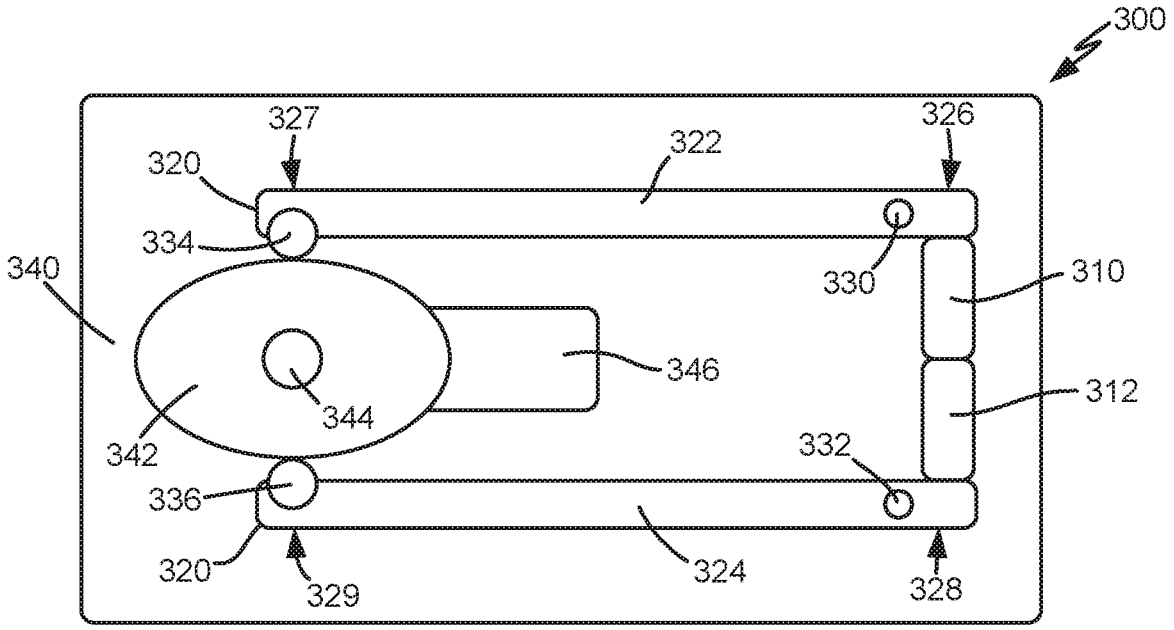

Cam 342 is rotatable about an axis by motor 340. In FIGS. 3 and 4, cam 342 is mounted to an axle 344, and axle 344 is rotatable by motor 340 about the axis. The axis extends into and out of the page in the view shown in FIGS. 3 and 4. Cam 342 may have a circular outer profile, e.g., in a plane that is perpendicular to the axis, and axle 344 may be mounted to cam 342 away from the center of cam 342. In alternative example embodiments, as shown in FIGS. 5 and 6, cam 342 may have a non-circular outer profile, e.g., in the plane that is perpendicular to the axis, such as an oval outer profile, and axle 344 may be mounted to cam 342 at the center of cam 342. Rollers 334, 336 may contact and ride on the outer profile of cam 342. Second end portion 327 of first elongated lever arm 322 may also be positioned opposite second end portion 329 of second elongated lever arm 324 on cam 342 as shown in FIGS. 3 through 6. Alternatively, second end portion 327 of first elongated lever arm 322 may be positioned at the same side of cam 342 as second end portion 329 of second elongated lever arm 324 as shown in FIGS. 7 and 8.

Mechano-caloric heat pump 300 may also include a fluid pump 346, such as pump 42, that is coupled to motor 340. Thus, motor 340 may drive both cam 342 and pump 346 in certain example embodiments. Pump 346 may be coupled to motor 340 via shaft 344 in certain example embodiments. Pump 346 is configured to flow heat transfer fluid through mechano-caloric stages 310, 312, heat exchangers 32, 34, etc., as discussed in greater detail below. Pump 346 may continuously flow the heat transfer fluid through mechano-caloric stages 310, 312. Alternatively, pump 346 may positively displace the heat transfer fluid through mechano-caloric stages 310, 312, e.g., in a periodic manner.

Figure 7:
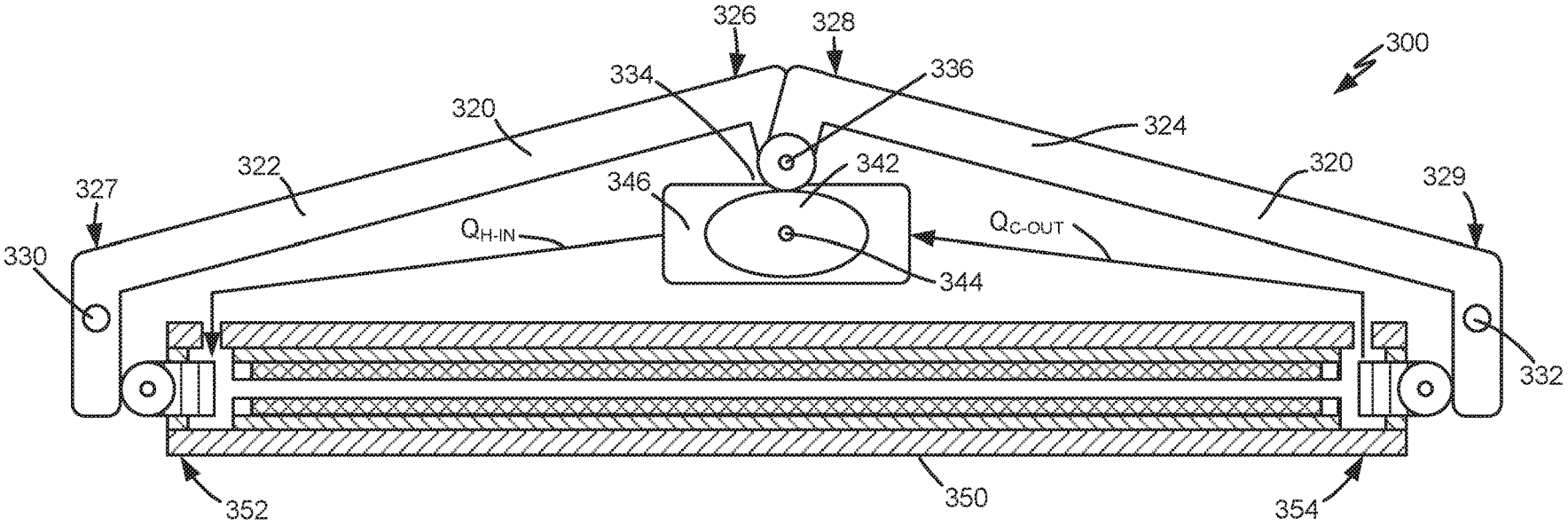
FIGS. 7 and 8 are schematic views of a mechano-caloric heat pump according to an additional example embodiment of the present subject matter.
Figure 8:
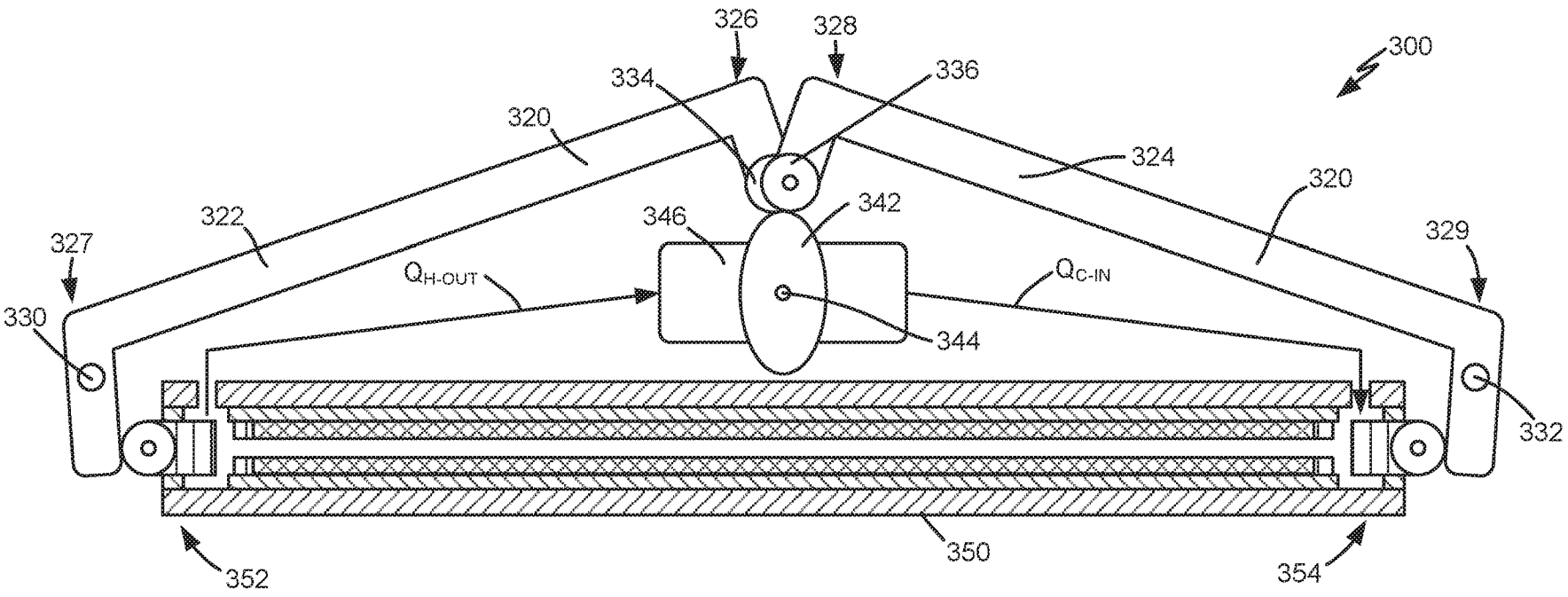

In FIGS. 7 and 8, mechano-caloric heat pump 300 includes an elongated mechano-caloric stage 350 rather than the two mechano-caloric stages 310, 312. Elongated mechano-caloric stage 350 extends between a first end portion 352 and a second end portion 354, e.g., along the length of elongated mechano-caloric stage 350. First elongated lever arm 322 may be coupled to elongated mechano-caloric stage 350 proximate first end portion 352 of elongated mechano-caloric stage 350, and second elongated lever arm 324 may be coupled to elongated mechano-caloric stage 350 proximate second end portion 354 of elongated mechano-caloric stage 350. Elongated mechano-caloric stage 350 may be compressed between second end portions 327, 329 of first and second elongated lever arms 322, 324.

One or more of mechano-caloric stages 310, 312, 350 may include a mechano-caloric material, such as an elasto-caloric material, a baro-caloric material, etc. The mechano-caloric material may be constructed from a single mechano-caloric material or may include multiple different mechano-caloric materials, e.g., in a cascade arrangement. By way of example, refrigerator appliance 10 may be used in an application where the ambient temperature changes over a substantial range. However, a specific mechano-caloric material may exhibit the mechano-caloric effect over only a much narrower temperature range. As such, it may be desirable to use a variety of mechano-caloric materials within mechano-caloric stages 310, 312, 350 to accommodate the wide range of ambient temperatures over which refrigerator appliance 10 and/or an associated mechano-caloric heat pump may be used.

As noted above, mechano-caloric stages 310, 312, 350 include mechano-caloric material that exhibits the mechano-caloric effect. During deformation of mechano-caloric stages 310, 312, 350, the mechano-caloric material in mechano-caloric stages 310, 312, 350 is successively stressed and relaxed between a high strain state and a low strain state. The high strain state may correspond to when the mechano-caloric material is in compression and the mechano-caloric material is shortened relative to a normal length of the mechano-caloric material. Conversely, the low strain state may correspond to when the mechano-caloric material is not in compression and the mechano-caloric material is uncompressed relative to the normal length of the mechano-caloric material.

When the mechano-caloric material in mechano-caloric stages 310, 312, 350 is compressed to the high strain state, the deformation causes reversible phase change within the mechano-caloric material and an increase (or alternatively a decrease) in temperature such that the mechano-caloric material rejects heat to a heat transfer fluid. Conversely, when the mechano-caloric material is relaxed to the low strain state, the deformation causes reversible phase change within the mechano-caloric material and a decrease (or alternatively an increase) in temperature such that the mechano-caloric material receives heat from a heat transfer fluid. By shifting between the high and low strain states, mechano-caloric stages 310, 312, 350 may transfer thermal energy by utilizing the mechano-caloric effect of the mechano-caloric material in mechano-caloric stages 310, 312, 350.

FIGS. 3 through 6 are schematic views of mechano-caloric stages 310, 312 during operation of mechano-caloric heat pump 300. In FIG. 3, first stage 310 is in the low strain state, and second stage 312 is in the high strain state. Conversely, in FIG. 4, first stage 310 is in the high strain state, and second stage 312 is in the low strain state. First and second stages 310, 312 are in the high strain state in FIG. 5 and are in the low strain state in FIG. 6. First and second stages 310, 312 may deform by one-half percent (0.5%) between the high and low strain states. Motor 340 may operate to deform stages 310, 312 between the configurations shown in FIGS. 3 through 6 via elongated lever arms 320 and thereby transfer thermal energy.

As an example, working fluid may be flowable through or to stages 310, 312. In particular, with reference to FIGS. 2 and 3, warm working fluid (labeled $Q_{C\text{-}IN}$) from first heat exchanger 32 may enter second stage 312 via line 44 when second stage 312 is in the high strain state, and the working fluid receives additional heat from mechano-caloric material in second stage 312 as the mechano-caloric material in stage 312 is compressed and rejects heat under strain. The now warmer working fluid (labeled $Q_{H\text{-}OUT}$) may then exit second stage 312 via line 48 and flow to second heat exchanger 34 where heat is released to a location external to refrigeration compartment 30.

In addition, cool working fluid (labeled $Q_{H\text{-}IN}$) from second heat exchanger 34 may enter first stage 310 via line 50 when first stage 310 is in the low strain state, and the working fluid rejects additional heat to mechano-caloric material in first stage 310 as the mechano-caloric material in first stage 310 relaxes. The now cooler working fluid (labeled $Q_{C\text{-}OUT}$) may then exit first stage 310 via line 46, flow to first heat exchanger 32, and receive heat from refrigeration compartment 30.

Continuing the example, mechano-caloric stages 310, 312 may be deformed from the configuration shown in FIG. 3 to the configuration shown in FIG. 4. With reference to FIGS. 2 and 4, warm working fluid $Q_{C\text{-}IN}$ from first heat exchanger 32 may enter first stage 310 via line 44 when first stage 310 is in the high strain state, and the working fluid receives additional heat from mechano-caloric material in first stage 310 as the mechano-caloric material in first stage 310 is compressed and rejects heat under strain. The now warmer working fluid $Q_{H\text{-}OUT}$ may then exit first stage 310 via line 48 and flow to second heat exchanger 34 where heat is released to a location external to refrigeration compartment 30.

In addition, cool working fluid $Q_{H\text{-}IN}$ from second heat exchanger 34 may enter second caloric stage 312 via line 50 when second caloric stage 312 is in the low strain state, and the working fluid rejects additional heat to mechano-caloric material in second caloric stage 312 as the mechano-caloric material in second caloric stage 312 relaxes. The now cooler working fluid $Q_{C\text{-}OUT}$ may then exit second caloric stage 312 via line 46, flow to first heat exchanger 32, and receive heat from refrigeration compartment 30.

The above cycle may be repeated by deforming first and second caloric stages 310, 312 between the configurations shown in FIGS. 3 and 4. As may be seen from the above, first and second caloric stages 310, 312 alternately compress and relax mechano-caloric material within first and second caloric stages 310, 312 and utilizes working fluid (liquid or gas) to harvest the thermal effect. Although not shown, mechano-caloric heat pump 300 may also include valves, seals, baffles or other features to regulate the flow of working fluid described above. It will be understood that the arrangement shown in FIGS. 5 and 6 may be operated in the same or similar manner to that described above for FIGS. 3 and 4 with the understanding that first and second caloric stages 310, 312 are simultaneously alternately compressed and relaxed. Mechano-caloric stage 350 may also be operated in the same or similar manner to that described above for each of first and second caloric stages 310, 312.

Figure 9:
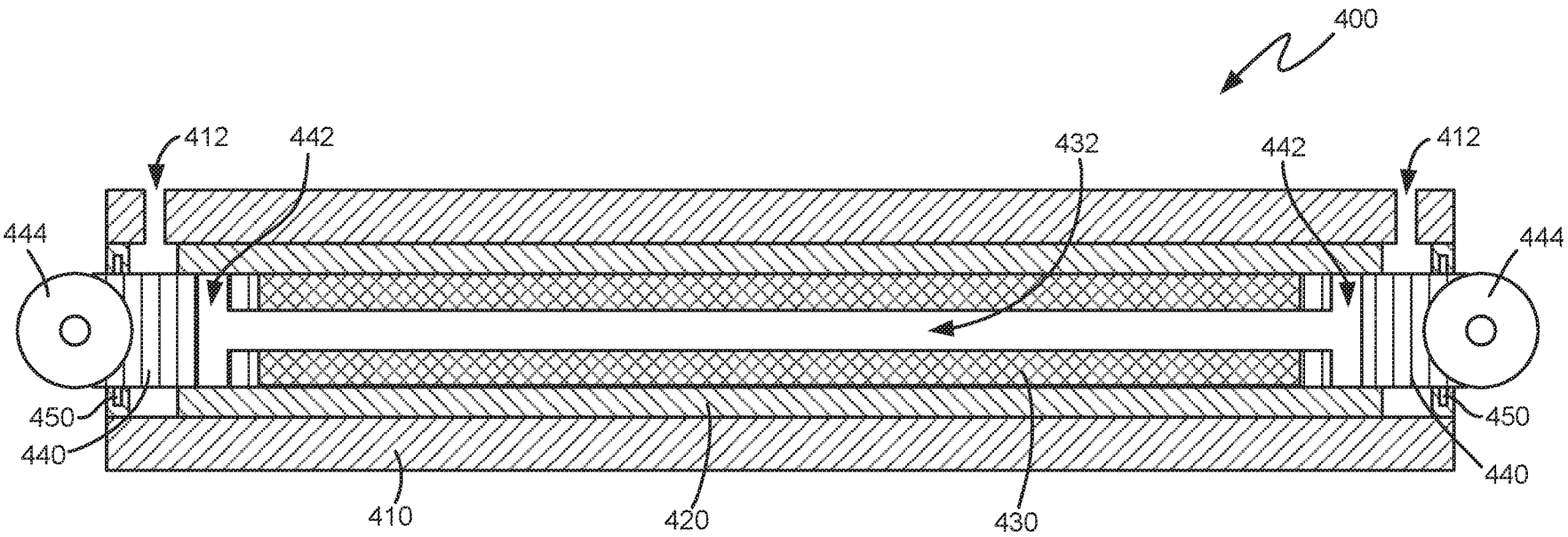
FIG. 9 is a section view of a mechano-caloric stage according to an example embodiment of the present subject matter.

FIG. 9 is a section view of a mechano-caloric stage 400 according to an example embodiment of the present subject matter. Mechano-caloric stage 400 may be used in or with any suitable mechano-caloric heat pump. For example, mechano-caloric stage 400 may be used in mechano-caloric heat pump 300 as mechano-caloric stage 350. As discussed in greater detail below, mechano-caloric stage 400 includes features for containing pressurized heat transfer fluid while reducing radial heat leakage.

As may be seen in FIG. 9, mechano-caloric stage 400 includes an elongated outer sleeve 410, an elongated inner sleeve 420 and a mechano-caloric material 430. Elongated inner sleeve 420 is disposed within elongated outer sleeve 410. Elongated outer sleeve 410 may be a metal, such as stainless steel or allow steel, elongated outer sleeve, and elongated inner sleeve 420 may be a plastic elongated inner sleeve. Such materials may assist with operation of mechano-caloric stage 400. For example, the metal elongated outer sleeve 410 may hold high radial heat transfer fluid pressures, and the plastic elongated inner sleeve 420 may assist with allowing subtle slipping of mechano-caloric material 430 on plastic elongated inner sleeve 420 while also limiting radial heat leakage.

Elongated outer and inner sleeves 410, 420 may be cylindrical. Thus, elongated outer sleeve 410 may have a circular cross-section along a length of elongated outer sleeve 410, and elongated inner sleeve 420 may also have a circular cross-section along a length of elongated inner sleeve 420. An outer diameter of elongated inner sleeve 420 may be selected to complement an inner diameter of elongated outer sleeve 410, e.g., such that friction between elongated outer and inner sleeves 410, 420 assists with mounting elongated inner sleeve 420 within elongated outer sleeve 410.

Mechano-caloric material 430 is disposed within elongated inner sleeve 420. Mechano-caloric stage 400 also includes a pair of pistons 440. Pistons 440 are received within elongated inner sleeve 420. Each of pistons 440 is positioned at a respective end of elongated inner sleeve 420. Thus, pistons 440 may be positioned opposite each other about mechano-caloric material 430 within elongated inner sleeve 420. Pistons 440 are moveable relative to elongated inner sleeve 420 and mechano-caloric material 430. In particular, pistons 440 may be slidable on elongated inner sleeve 420 in order to compress mechano-caloric material 430 between pistons 440 within elongated inner sleeve 420.

Seals 450, such as O-rings, may assist with limiting leakage of heat transfer fluid from within elongated inner sleeve 420 at the interface between elongated inner sleeve 420 and pistons 440. For example, a respective seal 450 may extend between each piston 440 and elongated inner sleeve 420. Each piston 440 may also include a roller 444. Rollers 444 may engage elongated lever arms 320 (FIGS. 3 through 8) described above.

Elongated outer sleeve 410 also defines a pair of ports 412. Each port 412 may be positioned at a respective end of elongated outer sleeve 410. Thus, ports 412 may be positioned at opposite ends of elongated outer sleeve 410. Heat transfer fluid may enter and exit elongated outer sleeve 410 via ports 412.

Mechano-caloric material 430 may also define one or more channels 432 that extend through mechano-caloric material 430 along a length of mechano-caloric material 430. Heat transfer fluid may flow through mechano-caloric material 430 via channel 432 of mechano-caloric material 430. Each of pistons 440 may define a passage 442 that is contiguous with channel 432 of mechano-caloric material 430 and a respective one of ports 412. Heat transfer fluid from ports 412 may flow through pistons 440 via passages 442 and enter or exit channel 432 of mechano-caloric material 430. Thus, heat transfer fluid may flow through mechano-caloric stage 400 via ports 412, passages 442 and channel 432.

Mechano-caloric material 430 may be an elasto-caloric material when mechano-caloric material 430 is formed with channel 432, and the heat transfer fluid within elongated inner sleeve 420 may contact mechano-caloric material 430 in channel 432. Such direct contact between mechano-caloric material 430 and heat transfer fluid may improve heat transfer, e.g., relative to when the heat transfer fluid does not contact mechano-caloric material 430 in channel 432. It will be understood that mechano-caloric material 430 may include any suitable number of channels 432 in alternative example embodiments.

Figure 10:
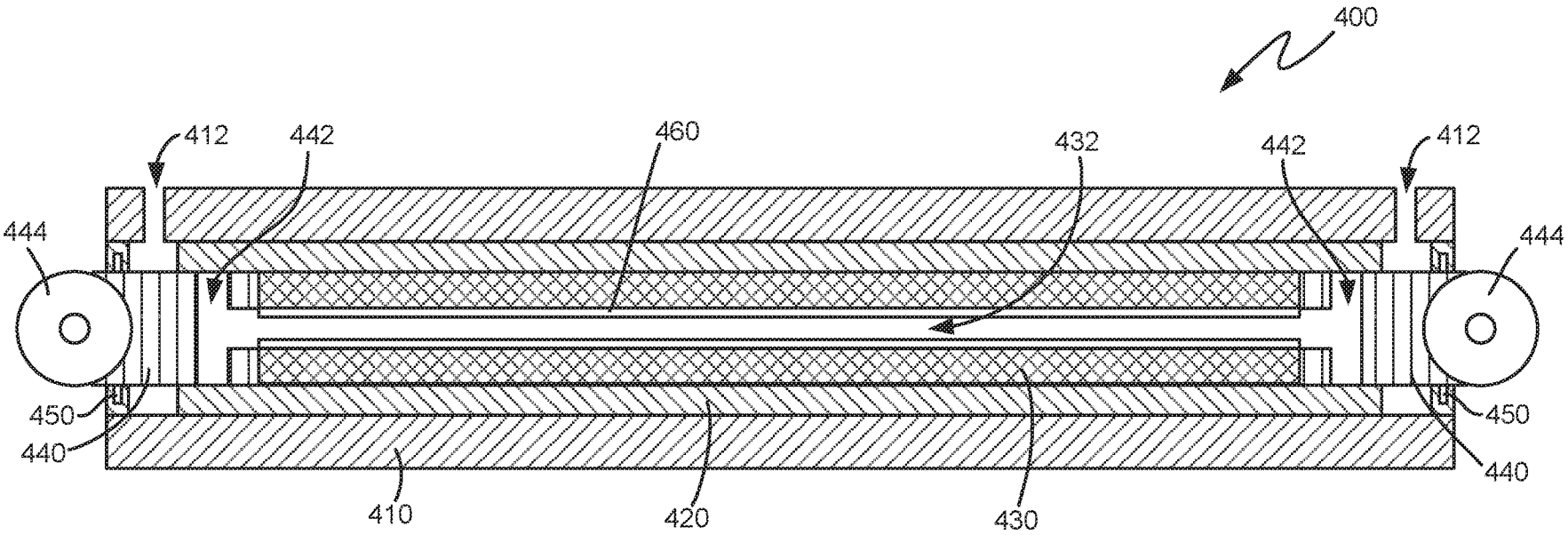
FIG. 10 is a section view of a mechano-caloric stage according to another example embodiment of the present subject matter.

FIG. 10 is a section view of a mechano-caloric stage 400 according to another example embodiment of the present subject matter. In FIG. 10, mechano-caloric stage 400 includes a fluid tube 460 positioned within mechano-caloric material 430 at channel 432. Fluid tube 460 may be a metal fluid tube and/or may extend along the length of mechano-caloric material 430 within channel 432. Heat transfer fluid in elongated inner sleeve 420 may flow through mechano-caloric material 430 via fluid tube 460. Mechano-caloric material 430 may be a baro-caloric material when mechano-caloric material 430 is formed with fluid tube 460, and the heat transfer fluid within elongated inner sleeve 420 may not contact mechano-caloric material 430 in channel 432. By limiting contact between baro-caloric material and the heat transfer fluid, dissolving of baro-caloric material by the heat transfer fluid may be reduced or prevented.

Figure 11:
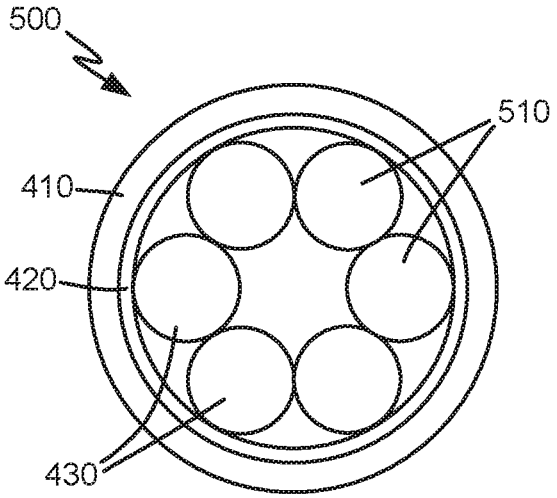
FIGS. 11 through 14 are section views of mechano-caloric stages according to various example embodiments of the present subject matter.

FIG. 11 is a section view a mechano-caloric stage 500. Mechano-caloric stage 400 may be constructed in the same or similar manner as mechano-caloric stage 500. As may be seen in FIG. 11, mechano-caloric stage 500 includes a plurality of elongated elasto-caloric wires 510. Thus, e.g., mechano-caloric material 430 may be formed into elongated elasto-caloric wires 510 in mechano-caloric stage 400. Elongated elasto-caloric wires 510 are packed within elongated inner sleeve 420. In particular, each elongated elasto-caloric wire 510 may contact elongated inner sleeve 420 and an adjacent pair of elongated elasto-caloric wires 510. Heat transfer fluid may flow within gaps between elongated elasto-caloric wires 510 in elongated inner sleeve 420. Mechano-caloric material 430 may be an elasto-caloric material when mechano-caloric material 430 is formed into elongated elasto-caloric wires 510, and the heat transfer fluid within elongated inner sleeve 420 may contact elongated elasto-caloric wires 510. Such direct contact between mechano-caloric material 430 and heat transfer fluid may improve heat transfer, e.g., relative to when the heat transfer fluid does not contact mechano-caloric material 430 in the gaps between elongated elasto-caloric wires 510.

Figure 12:
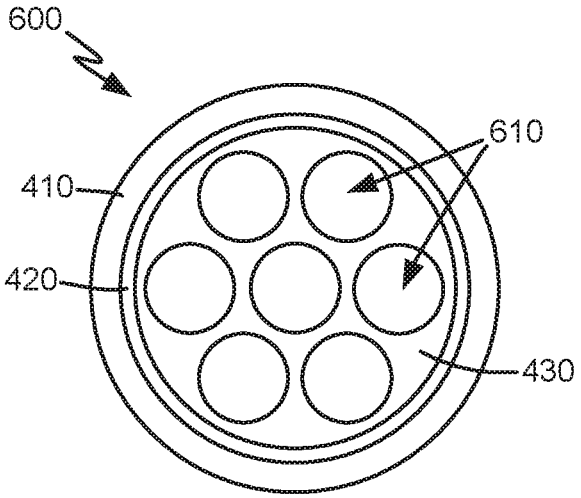

FIG. 12 is a section view a mechano-caloric stage 600. Mechano-caloric stage 400 may be constructed in the same or similar manner as mechano-caloric stage 600. As may be seen in FIG. 11, mechano-caloric material 430 may define a plurality of channels 610 that extend through mechano-caloric material 430, e.g., along a length of mechano-caloric material 430. Heat transfer fluid in elongated inner sleeve 420 may flow through mechano-caloric material 430 via channels 610. Mechano-caloric material 430 may be an elasto-caloric material when mechano-caloric material 430 is formed with channels 610, and the heat transfer fluid within elongated inner sleeve 420 may contact mechano-caloric material 430 in channels 610. Such direct contact between mechano-caloric material 430 and heat transfer fluid may improve heat transfer, e.g., relative to when the heat transfer fluid does not contact mechano-caloric material 430 in channels 610. It will be understood that mechano-caloric stage 600 may include any suitable number of channels 610 in alternative example embodiments.

Figure 13:
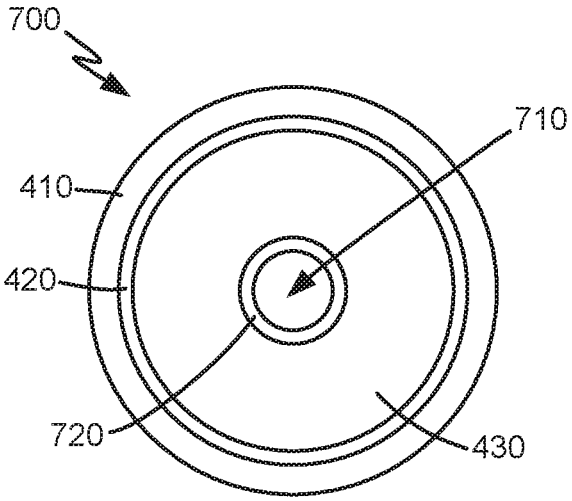

FIG. 13 is a section view a mechano-caloric stage 700. Mechano-caloric stage 400 may be constructed in the same or similar manner as mechano-caloric stage 700. As may be seen in FIG. 13, mechano-caloric material 430 may define a channel 710 that extends through mechano-caloric material 430, e.g., along a length of mechano-caloric material 430. A fluid tube 720 is positioned within mechano-caloric material 430 at channel 710. Fluid tube 720 may be a metal fluid tube and/or may extend along the length of mechano-caloric material 430 within channel 710. Heat transfer fluid in elongated inner sleeve 420 may flow through mechano-caloric material 430 via channel 710. Mechano-caloric material 430 may be a baro-caloric material when mechano-caloric material 430 is formed with channel 710 and fluid tube 720, and the heat transfer fluid within elongated inner sleeve 420 may not contact mechano-caloric material 430 in channel 710. By limiting contact between baro-caloric material and the heat transfer fluid, dissolving of baro-caloric material by the heat transfer fluid may be reduced or prevented.

Figure 14:
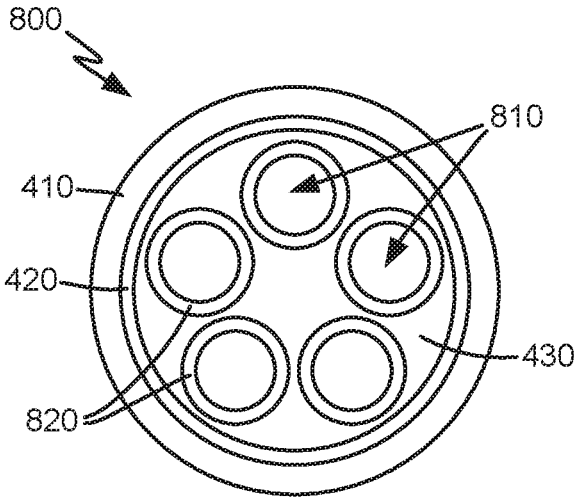

FIG. 14 is a section view a mechano-caloric stage 800. Mechano-caloric stage 400 may be constructed in the same or similar manner as mechano-caloric stage 800. As may be seen in FIG. 14, mechano-caloric material 430 may define a plurality of channels 810 that extend through mechano-caloric material 430, e.g., along a length of mechano-caloric material 430. A plurality of fluid tubes 820 are positioned within mechano-caloric material 430, e.g., such that each fluid tubes 820 is positioned within a respective channel 810. Heat transfer fluid in elongated inner sleeve 420 may flow through mechano-caloric material 430 via channels 810. Mechano-caloric material 430 may be a baro-caloric material when mechano-caloric material 430 is formed with channels 810 and fluid tubes 820, and the heat transfer fluid within elongated inner sleeve 420 may not contact mechano-caloric material 430 in channels 810. By limiting contact between baro-caloric material and the heat transfer fluid, dissolving of baro-caloric material by the heat transfer fluid may be reduced or prevented.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A mechano-caloric stage, comprising:

an elongated outer sleeve;

an elongated inner sleeve disposed within the elongated outer sleeve;

a pair of pistons received within the elongated inner sleeve, each of the pair of pistons positioned at a respective end of the elongated inner sleeve, the pair of pistons moveable relative to the elongated inner sleeve; and a mechano-caloric material disposed within the elongated inner sleeve between the pair of pistons, the mechano-caloric material compressible between the pair of pistons, wherein the pair of pistons are positioned against and contact the mechano-caloric material.

2. The mechano-caloric stage of claim 1, wherein the elongated outer sleeve is a metal elongated outer sleeve, and the elongated inner sleeve is a plastic elongated inner sleeve.

3. The mechano-caloric stage of claim 1, wherein the elongated outer sleeve has a circular cross-section along a length of the elongated outer sleeve, and the elongated inner sleeve has a circular cross-section along a length of the elongated inner sleeve.

4. The mechano-caloric stage of claim 1, wherein the mechano-caloric material is slidable against the elongated inner sleeve.

5. The mechano-caloric stage of claim 1, wherein the mechano-caloric material defines a channel that extends through the mechano-caloric material along a length of the mechano-caloric material.

6. The mechano-caloric stage of claim 5, wherein a heat transfer fluid is flowable through the channel of the mechano-caloric material, the heat transfer fluid contacting the mechano-caloric material when the heat transfer fluid flows through the channel of the mechano-caloric material.

7. The mechano-caloric stage of claim 6, wherein the channel is a plurality of channels, each of the plurality of channels extending through the mechano-caloric material along the length of the mechano-caloric material.

8. The mechano-caloric stage of claim 6, wherein the mechano-caloric material is an elasto-caloric material.

9. The mechano-caloric stage of claim 5, further comprising a fluid tube disposed within the channel of the mechano-caloric material, a heat transfer fluid flowable through the fluid tube, the fluid tube positioned between the heat transfer fluid within the fluid tube and the mechano-caloric material when the heat transfer fluid flows through the fluid tube.

10. The mechano-caloric stage of claim 9, wherein the channel is a plurality of channels and the fluid tube is a plurality of fluid tubes, each of the plurality of channels extending through the mechano-caloric material along the length of the mechano-caloric material, each fluid tube of the plurality of fluid tubes disposed within a respective channel of the plurality of channels.

11. The mechano-caloric stage of claim 9, wherein the mechano-caloric material is a baro-caloric material.

12. The mechano-caloric stage of claim 9, wherein the fluid tube is a metal fluid tube.

13. The mechano-caloric stage of claim 1, further comprising a pair of seals, each seal of the pair of seals extending between a respective one of the pair of pistons and the elongated inner sleeve.

14. The mechano-caloric stage of claim 1, wherein the mechano-caloric material comprises a plurality of elongated elasto-caloric wires.

15. The mechano-caloric stage of claim 1, wherein the elongated outer sleeve defines a pair of ports, each port of the pair of ports positioned at a respective end of the elongated outer sleeve.

16. The mechano-caloric stage of claim 15, wherein the mechano-caloric material defines a channel that extends through the mechano-caloric material along a length of the mechano-caloric material, each of the pair of pistons defining a passage that is contiguous with the channel of the mechano-caloric material and a respective one of the pair of ports.

17. The mechano-caloric stage of claim 1, wherein each of the pair of pistons comprises a roller positioned outside of the elongated outer sleeve.

18. A mechano-caloric stage, comprising:

a metal elongated outer sleeve;

a plastic elongated inner sleeve disposed within the metal elongated outer sleeve;

a pair of pistons received within the plastic elongated inner sleeve, each of the pair of pistons positioned at a respective end of the plastic elongated inner sleeve, the pair of pistons moveable relative to the plastic elongated inner sleeve; and a mechano-caloric material disposed within the plastic elongated inner sleeve between the pair of pistons, the mechano-caloric material compressible between the pair of pistons, wherein the mechano-caloric material is slidable against the elongated inner sleeve, wherein the elongated outer sleeve defines a pair of ports, each port of the pair of ports positioned at a respective end of the elongated outer sleeve, wherein the mechano-caloric material defines a channel that extends through the mechano-caloric material along a length of the mechano-caloric material, each of the pair of pistons defining a passage that is contiguous with the channel of the mechano-caloric material and a respective one of the pair of ports, and wherein the pair of pistons are positioned against and contact the mechano-caloric material.

* * * * *